US010190273B2

(12) United States Patent
Butler et al.

(10) Patent No.: US 10,190,273 B2
(45) Date of Patent: Jan. 29, 2019

(54) MANHOLE GUARD AND ATTACHABLE HOIST DEVICE

(71) Applicants: Michael Butler, Flat Rock, MI (US); John Lambert, Newport, MI (US)

(72) Inventors: Michael Butler, Flat Rock, MI (US); John Lambert, Newport, MI (US)

( * ) Notice: Subject to any disclaimer, the term of this patent is extended or adjusted under 35 U.S.C. 154(b) by 648 days.

(21) Appl. No.: 14/751,599

(22) Filed: Jun. 26, 2015

(65) Prior Publication Data

US 2016/0376758 A1 Dec. 29, 2016

(51) Int. Cl.
*E01F 13/02* (2006.01)
*B66F 19/00* (2006.01)

(52) U.S. Cl.
CPC ..... *E01F 13/02* (2013.01); *B66F 19/005* (2013.01)

(58) Field of Classification Search
CPC ..... E01F 13/02; B66F 19/005; A62B 1/04; A62B 1/00; B66D 1/60; B66D 1/605; B66C 23/166
See application file for complete search history.

(56) References Cited

U.S. PATENT DOCUMENTS

| | | | | |
|---|---|---|---|---|
| 1,741,323 | A | 12/1929 | Lufkin | |
| 1,882,150 | A | 10/1932 | Kent | |
| 3,444,793 | A | 5/1969 | Pelsue | |
| 5,022,489 | A | 6/1991 | Sauber | |
| 2008/0289905 | A1 | 11/2008 | Pelsue et al. | |
| 2011/0132685 | A1* | 6/2011 | Dos Santos | E04G 1/14 182/113 |

* cited by examiner

*Primary Examiner* — Sang K Kim
*Assistant Examiner* — Nathaniel L Adams
(74) *Attorney, Agent, or Firm* — MacMillan, Sobanski & Todd, LLC

(57) ABSTRACT

A manhole guard, methods of assembling the same, and methods of using the same, are described. The manhole guard generally includes a plurality of sections connected for movement, the sections being capable of being locked into a fixed rigid structure through the use of a first arm and second arm that act independently of each other. The manhole guard can include attachable mounting brackets designed to facilitate the attachment of a hoist device and/or winch.

7 Claims, 6 Drawing Sheets

MANHOLE GUARD AND ATTACHABLE HOIST DEVICE

CROSS-REFERENCE TO RELATED APPLICATIONS

None.

BACKGROUND OF THE INVENTION

Manholes form an interface between the surface and subsurface. Manholes provide access to underground networks that contain vital infrastructure such as utility and sewage systems. To service this underground infrastructure, manholes must be temporarily uncovered to permit the transport of materials and personnel between the surface and subsurface.

Servicing this underground infrastructure poses a variety of safety concerns for workers and members of the general public. Materials need to be safely transported between the surface and subsurface without damage to supplies or injury to unsuspecting workers below. Workers need to be transported between the surface and subsurface without injury to the worker or, in the case of a worker injured below, to assist the injured worker. In addition, both workers and members of the general public run the risk of injury from falling into, or tripping over, uncovered manholes.

To address these and other safety concerns, portable manhole guards were created to safely identify and limit access to manholes that are temporarily uncovered. In addition, hoist devices were developed to be attached to manhole guards to safely transport materials and personnel between the surface and underground. However, conventional manhole guards and hoist devices suffer durability, accessibility, assembly, and portability problems. Thus, there is a need in the art for new and improved manhole guards.

SUMMARY OF THE INVENTION

Provided herein is a manhole guard with a plurality of sections connected for movement. The sections include a center section, a first wing, and a second wing, where the center section includes a first post and a second post connected by at least one center section rail, the first wing includes a first wing post connected to the first post by at least one first wing rail, and the second wing includes a second wing post connected to the second post by at least one second wing rail. The manhole guard further includes a first arm connected to the center section that is capable of locking the first wing into a fixed position relative to the center section, and a second arm connected to the center section that is capable of locking the second wing into a fixed position relative to the center section. The first and second arms operate independently of each other.

In certain embodiments, at least one of the first arm or the second arm includes a spring-loaded latch mechanism configured to accept either the first wing or the second wing. In certain embodiments, at least one of the first post, the second post, the first wing post, or the second wing post includes a telescopically-fitted adjustable foot. In certain embodiments, the first arm is connected to the center section on a center section rail, and the second arm is connected to the center section on the center section rail. In certain embodiments, the first wing extends from the center section at about a 90 degree angle when in a locked position. In certain embodiments, the second wing extends from the center section at about a 90 degree angle when in a locked position. In certain embodiments, the first arm has a first latch mechanism adapted to secure the first wing into the fixed position relative to the center section, and the second arm has a second latch mechanism adapted to secure the second wing into the fixed position relative to the center section. In particular embodiments, at least one of the first latch mechanism or the second latch mechanism is coupled with a curved capping portion designed to fit securely over the first wing rail or the second wing rail. In particular embodiments, the at least one of the first latch mechanism or the second latch mechanism includes a hood housing the curved capping portion, a spring, a bolt, a latch, and a trigger, where the spring spans the bolt and the trigger is configured to either increase or decrease tension on the spring.

Further provided is a manhole guard having a plurality of sections connected for movement, a first mounting bracket, and a second mounting bracket. The hingedly connected sections include a center section, a first wing, and a second wing, where the center section includes a first post and a second post connected by at least one center section rail, the first wing includes a first wing post connected to the first post by at least an upper first wing rail and a lower first wing rail, and the second wing includes a second wing post connected to the second post by at least an upper second wing rail and a lower second wing rail. The first mounting bracket is connected to the first wing, and the second mounting bracket is connected to the second wing. The first mounting bracket has a first top recess, a first middle recess, and a first lower recess, where the first lower recess is configured to accept the first lower wing rail in an interference fit, and the first middle recess is configured to accept the first upper wing rail in an interference fit. The second mounting bracket has a second top recess, a second middle recess, and a second lower recess, where the second lower recess is configured to accept the second lower wing rail in an interference fit, and the second middle recess is configured to accept the second upper wing rail in an interference fit.

In certain embodiments, the manhole guard further includes a first arm connected to the center section capable of locking the first wing into a fixed position relative to the center section, and a second arm connected to the center section capable of locking the second wing into a fixed position relative to the center section, where the first and second arms operate independently of each other. In particular embodiments, at least one of the first arm or the second arm includes a spring-loaded latch mechanism configured to accept either the first wing or the second wing, respectively.

In certain embodiments, the manhole guard further includes a crossbar having a first end and a second end, the first end being disposed in the first top recess, and the second end being disposed in the second top recess. In particular embodiments, the manhole guard further includes a hoist device suspended on the crossbar.

In certain embodiments, at least one of the first post, the second post, the first wing post, and the second wing post, includes a telescopically-fitted adjustable foot.

In certain embodiments, the manhole guard further includes a platform attached to at least one of the first mounting bracket or the second mounting bracket, the platform being capable of supporting a winch. In particular embodiments, the manhole guard further includes a winch disposed on the platform.

In certain embodiments, the manhole guard further includes a mounting plate configured to secure at least one of (i) the first mounting bracket to the first wing or (ii) the second mounting bracket to the second wing.

Further provided is a method of restricting access to a manhole. The method includes the steps of: arranging a manhole guard in proximity to a manhole, wherein the manhole guard comprises a plurality of sections connected for movement, the sections including a center section, a first wing, and a second wing, wherein the center section comprises a first post and a second post connected by at least one center section rail, the first wing comprises a first wing post connected to the first post by at least one first wing rail, and the second wing comprises a second wing post connected to the second post by at least one second wing rail; locking the first wing into a fixed position with respect to the center section with a first arm, the first arm comprising a spring-loaded latch mechanism configured to accept the first wing rail; and locking the second wing into a fixed position with respect to the center section with a second arm, the second arm comprising a spring-loaded latch mechanism configured to accept the second wing rail.

In certain embodiments, the method further includes assembling a hoist device on the manhole guard. In particular embodiments, the hoist device is suspended from a crossbar extending between a first mounting bracket and a second mounting bracket, where the first mounting bracket is mounted on the first wing and the second mounting bracket is mounted on the second wing.

In certain embodiments, the first wing extends from the center section at about a 90 degree angle when locked in the fixed position, and the second wing extends from the center section at about a 90 degree angle when locked in the fixed position.

In certain embodiments, at least one of the first latch mechanism or the second latch mechanism includes a hood housing a curved capping portion configured to accept a wing rail, a spring, a bolt, a latch, and a trigger, where the spring spans the bolt and the trigger is configured to either increase or decrease tension on the spring.

BRIEF DESCRIPTION OF THE DRAWINGS

FIG. 5A shows an elevated angled view of the second mounting bracket with a winch platform and mounting plate attached. FIG. 5B shows a lateral view of the first top recess of the first mounting bracket.

DETAILED DESCRIPTION OF THE PREFERRED EMBODIMENTS

Various embodiments are described in the present disclosure in the context of a manhole guard. Those of ordinary skill in the art will realize that the following detailed description of the embodiments is illustrative only and not intended to be in any way limiting. Other embodiments will readily suggest themselves to such skilled persons having the benefit of the disclosure. References to an "embodiment," "aspect," or "example" in this disclosure indicate that the embodiments of the invention so described may include a particular feature, structure, or characteristic, but not every embodiment necessarily includes the particular feature, structure, or characteristic. Further, repeated use of the phrase "in one embodiment" does not necessarily refer to the same embodiment, although it may.

Described herein is a manhole guard that addresses various problems in the art. The present disclosure provides a portable manhole guard that, in some embodiments, is easy to assemble, is durable, will not collapse while transporting weighted materials, is stable, is adjustable, is capable of folding flat on itself, and does not hinder access to a manhole during use. Furthermore, any suitable hoist device is capable of being easily attached to the manhole guard and supported by the frame and structure of the manhole guard. The manhole guard described herein thus has many advantages that provide improved durability, stability, and safety, and solve various problems related to manhole access and transport of weight between the surface and subsurface.

Figure 1:
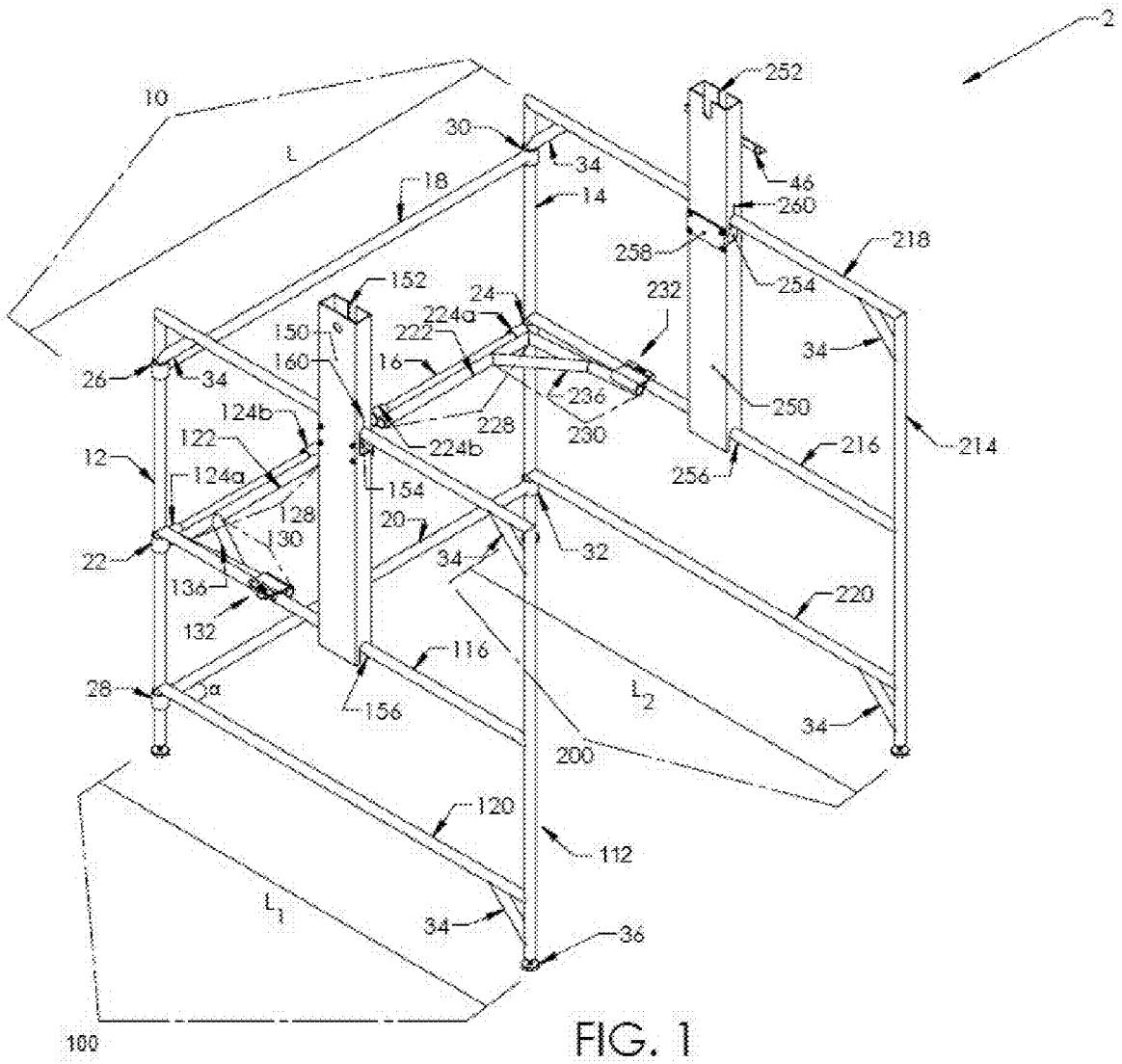
FIG. 1: Perspective view of the portable manhole guard with attachable mounting brackets for a hoist device and telescopically-fitted adjustable feet in accordance with the present disclosure.

As seen in FIG. 1, the embodiment with two wings, when assembled, permits restricted access to the uncovered manhole. Restricted access, like that shown in FIG. 1, is important for the safe transportation of materials and personnel between the surface and subsurface through a manhole.

Referring now to FIGS. 1-4, the manhole guard 2 generally has a plurality of sections connected for movement, the sections including a center section 10, a first wing 100, and a second wing 200. The connection for movement allows, for example, the first wing 100 and the second wing 200 to rotate around an axis defined by a first post 12 and a second post 14, respectively. This allows the manhole guard 2 to fold flat upon itself for easy transport, assembly, and storage.

The center section 10 has a first post 12 and a second post 14 that are connected by at least one center rail 16. In some embodiments, the first post 12 and the second post 14 are connected by multiple center rails 16, 18, 20. In one non-limiting example, the manhole guard 2 has three center rails (an upper center rail 18, a middle center rail 16, and a lower center rail 20) extending between, and connecting, the first post 12 and the second post 14. In use, the first post 12 and second post 14 rest on the ground or other surface in proximity to a manhole.

A first wing 100 is pivotably or hingedly connected to the first post 12 such that the first wing 100 can rotate around the axis defined by the first post 12. The first wing 100 has a first wing post 112 that connects to the first post 12 of the center section 10 by at least one first wing rail 116. In some embodiments, the first wing post 112 is connected to the first post 12 by multiple first wing rails 116, 118, 120. By way of a non-limiting example, the first wing 100 may include an upper first wing rail 118, a middle first wing rail 116, and a lower first wing rail 120, all of which extend between, and connect, the first wing post 112 and the first post 12.

A second wing 200 is pivotably or hingedly connected to the second post 14 such that the second wing 200 can rotate around the axis defined by the second post 14. The second wing 200 has a second wing post 214 that connects to the second post 14 of the center section 10 by at least one second wing rail 216. In some embodiments, the second wing post 214 is connected to the second post 14 by multiple second wing rails 216, 218, 220. By way of a non-limiting example, the second wing 200 may include an upper second wing rail 218, a middle second wing rail 216, and a lower second wing rail 220, all of which extend between, and connect, the second wing post 214 and the second post 14.

The first post 12 has at least one first post hinge 22 comprising an internal pivot and external pivot which permit radial rotation of the first wing 100 around the axis defined by the first post 12. Alternatively, the first post hinge 22 can be a hollow circular end of the center rail 16 that the first post 12 runs through in a manner so as to allow the rotation of the first post 12 in the hollow circular end. Similarly, the second post 14 has at least one second post hinge 24 comprising an internal pivot and external pivot which permit radial rotation of the second wing 200 around the axis defined by the second post 14. Alternatively, the second post hinge 24 can be a hollow circular end of the center rail 16 that the second post 14 runs through in a manner so as to allow the rotation of the second post 14 in the hollow circular end. The first post 12 may further include an upper first post hinge 26 and a lower first post hinge 28, and the second post 14 may further include an upper second post hinge 30 and a lower second post hinge 32. Any hinge may further include a welded gusset for added strength and rigidity.

In some embodiments, the height of each wing's lower rail 120, 220, middle rail 116, 216, and upper rail 118, 218, relative to the height of the lower center rail 20, middle center rail 16, and upper center rail 18, is independently customizable. By way of a non-limiting example, in one embodiment, such as depicted in FIG. 1, the first upper wing rail 118 is at a height relative to the ground or other surface equal to that of the upper second wing rail 218, which is different from that of the upper center rail 18.

In some embodiments, in order to prevent access to an open manhole, one or more (preferably two) chains can be run from the first wing 100 to the second wing 200. The chains are attached at one end to the first wing post 112, and at the other end to the second wing post 214. The chains can be made of stainless steel or any other suitable material. At one of the wing posts 112, 214, each chain is connected to a clip hanging off a ring welded to the wing post 112, 214. At the other wing post 112, 214, each chain removably clips to a ring affixed to the wing post 112, 214. In use, the chains are simply clipped onto the wing post 112, 214 to which they are not already affixed, thereby creating a barrier that hinders access to the manhole which the manhole guard 2 surrounds.

In another embodiment, the manhole guard 2 has a third wing in addition to the center section 10, first wing 100, and second wing 200. The third wing can be attached to the first wing post 112 and second wing post 214 to entirely surround an uncovered manhole and obstruct any access to the manhole. Embodiments containing a third wing thus provide for enhanced safety surrounding an open manhole.

In some embodiments, the manhole guard 2 has one or more support rails 34 that reinforce the manhole guard structure. Generally, a support rail 34 can be utilized to connect any wing rail to an adjacent post or wing post. Furthermore, a support rail 34 can be utilized to connect any wing rail 116, 118, 120, 216, 218, 220 to any rail or wing post in the same wing. By way of one non-limiting example, and as depicted in FIG. 1, a support rail 34 can connect any of: the upper first wing rail 118 to the first wing post 112, the upper second wing rail 218 to the second wing post 214, the upper second wing rail 218 to the second post 14, and the upper first wing rail 118 to the first post 12. Support rails 34 can also be utilized to connect the lower first wing rail 120 to the first post 12, the lower first wing rail 120 to the first wing post 112, the lower second wing rail 220 to the second post 14, or the lower second wing rail 220 to the second wing post 214. By utilizing one or more support rails 34 to connect a wing rail to an adjacent wing post, the entire manhole guard structure can be reinforced.

In an alternative embodiment, instead of using support rails 34, the upper first wing rail 118, the first post 12, and the first wing post 112 can be manufactured as one solid piece with a slight curve where the first post 12 meets the upper first wing rail 118, and where the first wing post 112 meets the upper first wing rail 118. Similarly, the upper second wing rail 218, the second post 14, and the second wing post 214 can be manufactured as one solid piece with a slight curve where the second post 14 meets the upper second wing rail 218, and where the second wing post 214 meets the upper second wing rail 218. This method of manufacturing the manhole guard reduces the costs production, and can result in increased stability of the manhole guard.

Figure 2:
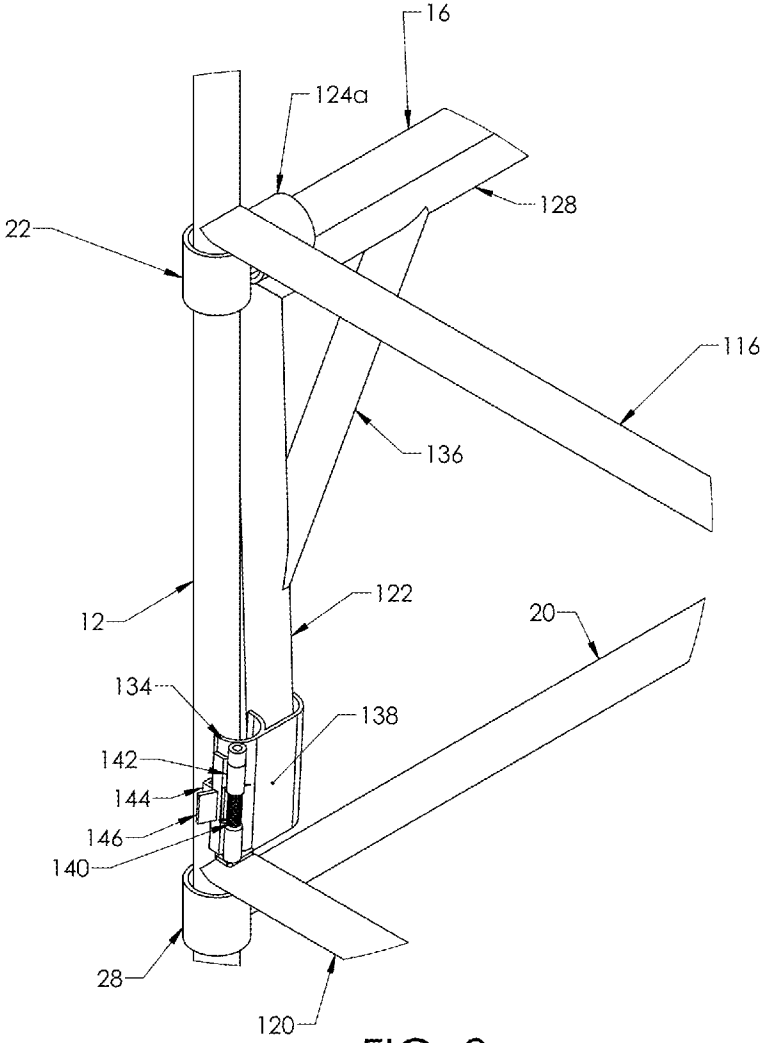
FIG. 2: View of the first arm in an unlocked position. When in use, the first arm locks the first wing of the manhole guard into a fixed position. The second arm locks the second wing of the manhole guard into a fixed position.

As depicted in FIGS. 1-2, the manhole guard 2 includes a first arm 122 and a second arm 222 that operate independently of each other. The first arm 122 is connected to the center section 10 on the center rail 16, and is capable of locking the first wing 100 into a fixed position relative to the center section 10. The second arm 222 is connected to the center section 10 on the center rail 16, and is capable of locking the second wing 200 into a fixed position relative to the center section 10. The independent operation of each arm allows for a variety of possible configurations of the manhole guard 2, thereby permitting the user to alter the access to the uncovered manhole for transport purposes or to account for any obstruction where the manhole is located. For example, the first arm 122 can be utilized to lock the first wing 100 in a fixed position relative to the center section 10 while the second wing 200 is not locked in a fixed position relative to the center section 10, and vice versa.

As seen in the embodiment of FIG. 2, the first arm 122 and second arm 222 are pivotably or hingedly connected to a center rail 16 of the center section. In embodiments where the center section 10 has multiple center rails, the first arm 122 and the second arm 222 are generally connected to the middle center rail 16 for optimal stability of the manhole guard 2. By way of a non-limiting example, in one embodiment, the first arm 122 and the second arm 222 each has a plurality of hinged attachments 124*a*, 124*b*, 224*a*, 224*b* to the center rail 16 of the center section 10. Multiple points of connection between the first arm 122 and center rail 16, and the second arm 222 and the center rail 16, lead to a stronger, longer-lasting attachment of each arm 122, 222 to the center rail 16 and ensure better distribution of force throughout an arm 122, 222 when the arm 122, 222 is in use. In other embodiments, due to the fact that the first arm 122 and the second arm 222 operate independently, the first arm 122 and the second arm 222 can be connected to different rails in the center section 10. As a non-limiting example of such an embodiment, the first arm 122 can be connected to the center section 10 at the center rail 16 while the second arm 222 is connected to the center section 10 at the upper center rail 18. As another non-limiting example, the second arm 222 can be connected to the center section 10 at the upper center rail 18 while the first arm is connected to the center section at the lower center rail 20.

The hinged attachment of the first and second arms 122, 222 to a rail in the center section 10 permits the first and second arms 122, 222 to each independently move between an unlocked position and a locked position. In the unlocked position, each arm 122, 222 can be co-planar with the center section 10 (i.e., the arm can be parallel to the first and second posts 12, 14), but even if the arm is not fully co-planar with the center section 10, the respective wing can be unlocked. That is, so long as the arm 122, 222 is not in a locked position, the corresponding wing 100, 200 is free to rotate about the axis of the respective post 12, 14. In the locked position, as depicted in FIG. 1 and FIG. 7, the arm 122, 222 is attached to the corresponding wing 100, 200, thereby preventing the wing 100, 200 from rotating about the axis of the respective post 12, 14. In the locked position, the first or second arm 122, 222 locks the respective wing 100, 200 in place with respect to the center section 10. In certain embodiments, the locked position preferably results in the first wing 100 extending at an angle a of about 90 degrees from the center section 10, and the second wing 200 extending at an angle β of about 90 degrees from the center section 10, such that the three sections 10, 100, 200 form three sides of a square. It is understood, however, that the lengths of the center section 10, first wing 100, and second wing 200 (L, $L_1$, and $L_2$, respectively) need not be equal, in which case the preferable locked position forms a rectangle instead of a square. In certain embodiments, the first and second arms 122, 222 are configured such that the manhole guard 2 can fold flat on itself when the arms are in a specific unlocked position, as depicted in part in FIG. 2.

In some embodiments, each arm 122, 222 is separable from the manhole guard 2. However, several benefits are recognized by a pivotable or hinged attachment of each arm 122, 222 to the manhole guard 2 in general. A pivotable or hinged attachment prevents an arm or arms from being misplaced or lost. Furthermore, a pivotable or hinged attachment of the arms 122, 222 facilitates easier transport and assembly of the manhole guard 2 because there are fewer parts to carry and connect when the arms 122, 222 are attached.

In some embodiments, the first arm 122 and the second arm 222 have telescopically fitted extensions. The extensions permit the arms to be expanded and contracted as necessary. As a result, the manhole guard 2 is capable of assuming a variety of configurations while maintaining stability due to the first and second arms 122, 222 reinforcing the manhole guard structure.

Figure 3B:
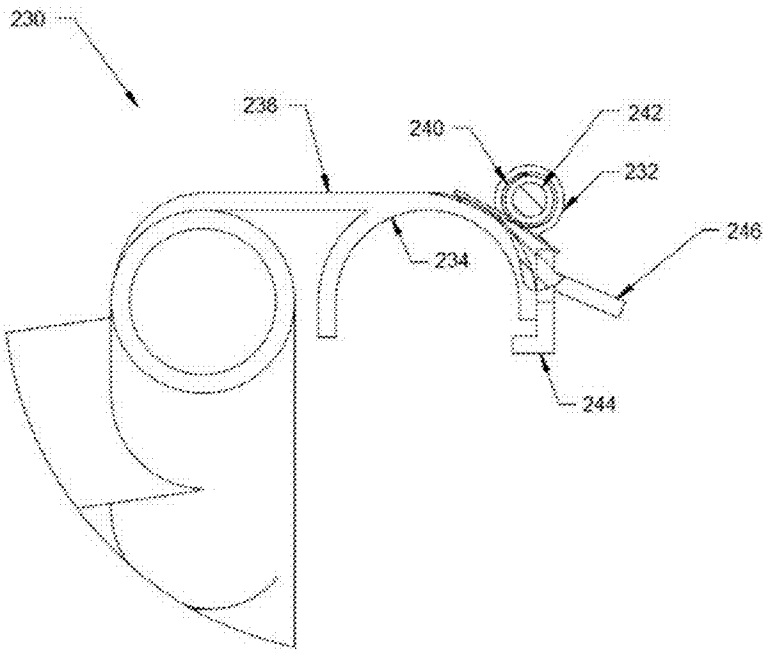
FIGS. 3A-3B: Lateral views of the latch mechanism on the first arm (FIG. 3A), which is used to secure the first wing into a fixed position, and the latch mechanism on the second arm (FIG. 3B), which is used to secure the second wing into a fixed position.
Figure 3A:
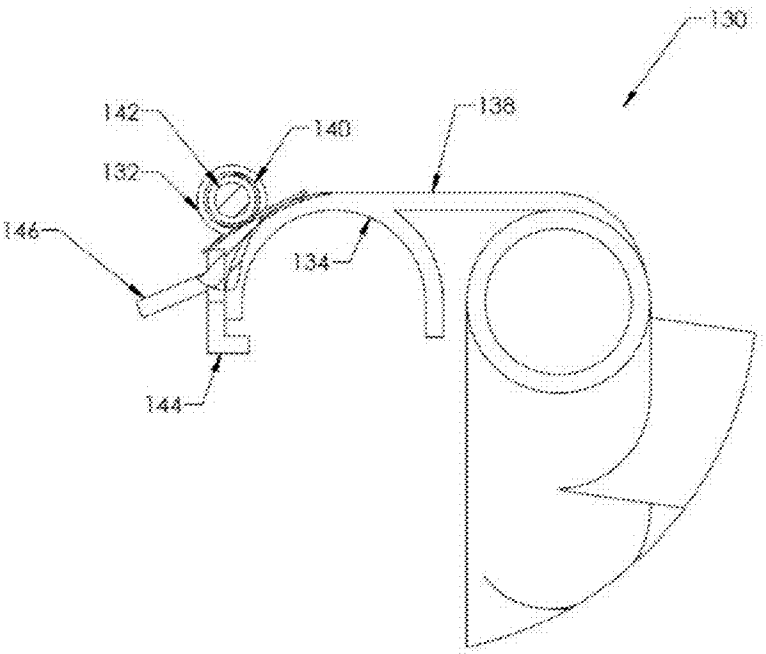

As depicted in FIGS. 3A-3B, the first and second arms 122, 222 each have a hinged end 128, 228 that attaches to the center section 10 (preferably, though not necessarily, at the center rail 16), and a wing end 130, 230 that attaches to the respective wing 100, 200. The hinged end 128, 228 is typically a metal railing that can be attached to the center section 10 through the use of multiple hinges 124*a*, 124*b*, 224*a*, 224*b* which assist in more evenly displacing force throughout the manhole guard 2. The wing end 128, 228 defines a latch mechanism 132, 232 coupled with a curved capping 134, 234 portion designed to fit securely over at least half the circumference of the wing rail 116, 216 being locked into place, as illustrated in FIGS. 3A-3B. In some embodiments, the first arm 122 and second arm 222 each has at least one support arm 136, 236 that connects the arm's hinged end 128, 228 to the arm's wing end 130, 230. In one non-limiting example, the support arm 136, 236 creates a triangular reinforcement between the respective arm's hinged end 128, 228 and wing end 130, 230.

The first and second arms 122, 222 each include a latch mechanism (a first latch mechanism 132 and a second latch mechanism 232, respectively) located at the wing end 130, 230. In an alternative embodiment, only one of the arms includes a latch mechanism. Each latch mechanism 132, 232 permits the respective wing 100, 200 to be securely fastened to the center section 10. This ensures the manhole guard 2 remains in a fixed and stable position, which is important for weighted transportation by a hoist device. In certain embodiments, the latch mechanism 132, 232 is attached to the respective arm 122, 222 by a ball joint.

Each latch mechanism 132, 232 has a hood 138, 238 housing the curved capping portion 134, 234, a spring 140, 240, a bolt 142, 242, a latch 144, 244, and a trigger 146, 246. The spring 140, 240 spans the bolt 142, 242. The spring-bolt combination can be in an unloaded or loaded state. To transition from an unloaded state to a loaded state, the trigger 146, 246 is depressed, which increases tension on the spring 140, 240 and thereby loads the latch mechanism 132, 232. The tension engages the latch 144, 244 which locks the latch 144, 244 onto a welded ridge on the wing rail 116, 216 and secures the curved capping portion 134, 234 to the wing rail 116, 216. In the alternative, the spring 140, 240 begins in the loaded position, in which case releasing the trigger 146, 246 releases tension on the spring 140, 240 and thus disengages the latch 144, 244, thereby unlocking the latch 144, 244. Regardless of whether the spring latch mechanism 132, 232 begins in a loaded or unloaded position, a hood 138, 238 covers the latch 144, 244 and trigger 146, 246 so as to protect the latch 144, 244 and trigger 146, 246 from damage. The hood 138, 238 is generally curved, but other shapes are possible. The first and second latch mechanisms 132, 232 connected to each respective arm 122, 222, and the multiple-hinged connection of each arm 122, 222 to the center section 10, together enable each arm 122, 222 to secure a wing section 100, 200 in a variety of configurations while still stabilizing the manhole guard.

Figure 4:
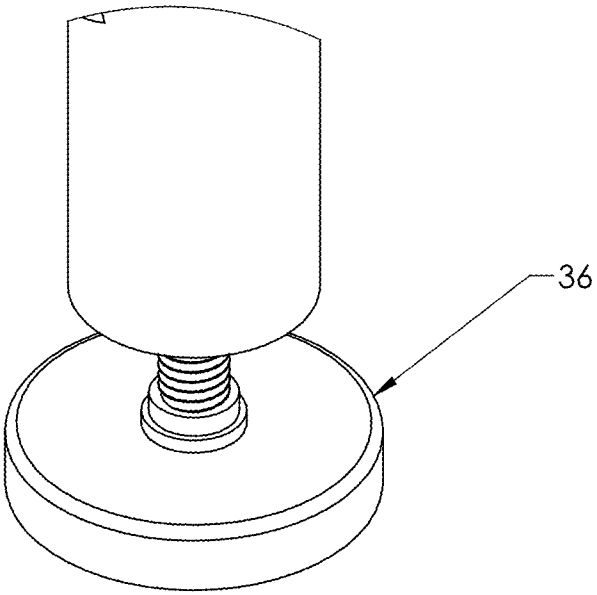
FIG. 4: View of a telescopically-fitted adjustable foot. The telescopically-fitted adjustable feet are used to balance the manhole guard on the ground and adjust the height or level of the manhole guard.

As seen in FIG. 4, any of the first post 12, second post 14, first wing post 112, and/or second wing post 214 can include a telescopically fitted adjustable foot 36. The first post 12, second post 14, first wing post 112, and second wing post 214 are generally configured to rest on the ground or other surface surrounding a manhole. The telescopically fitted adjustable feet 36 can be adjusted up or down relative to the ground or other surface, such that the manhole guard 2 rests firmly and relatively flat on the ground or other surface regardless of whether the ground or other surface is uniformly level. Each adjustable foot 36 can include a ball joint that permits the adjustable foot 36 to have complete contact with an uneven surface.

Figure 5B:
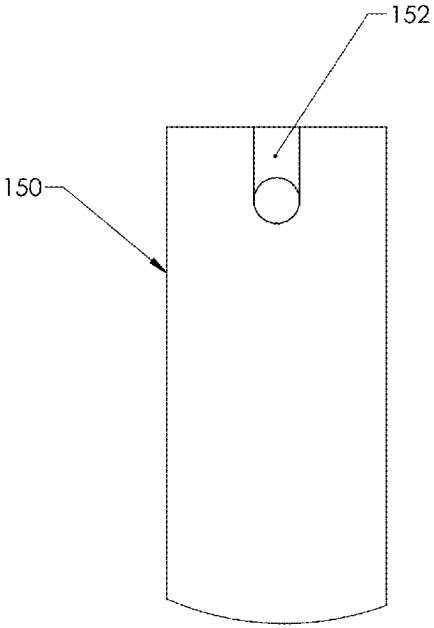
FIGS. 5A-5B: Views of non-limiting example configurations of the mounting brackets.
Figure 5A:
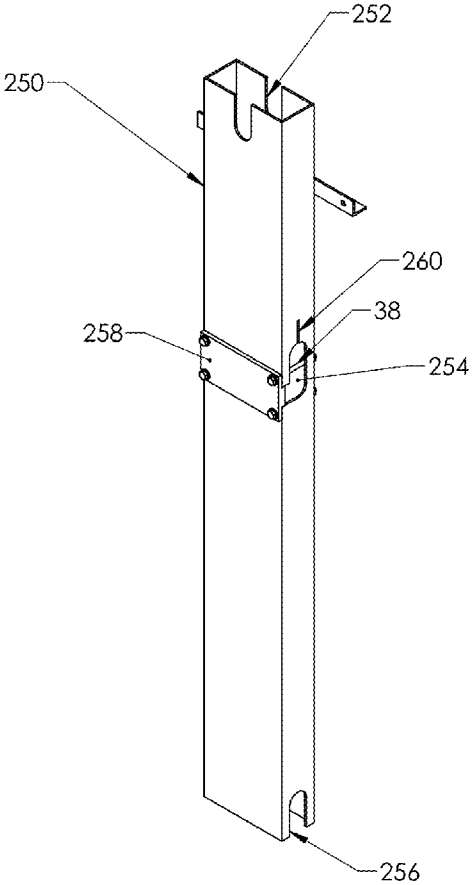
Figure 6:
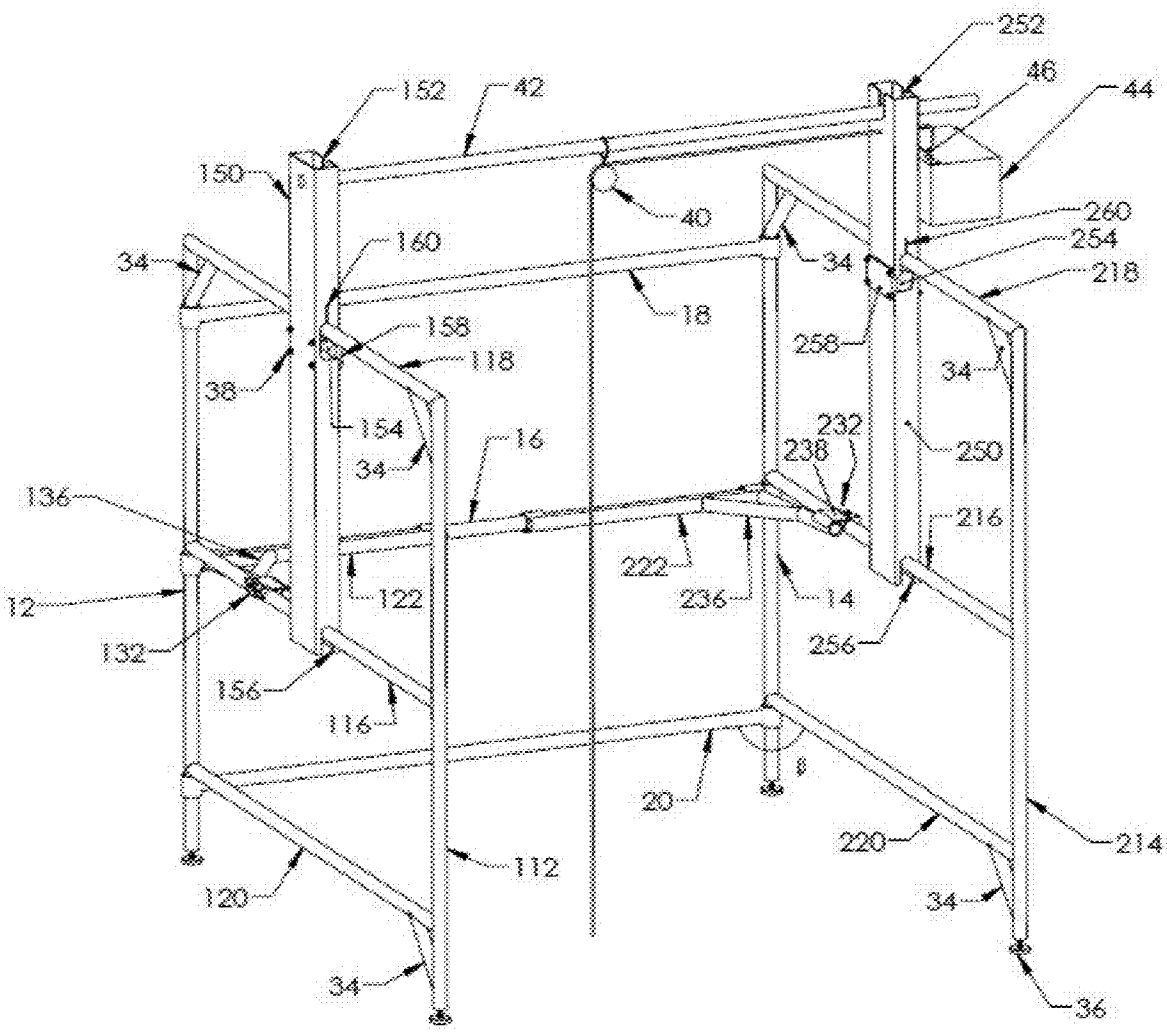
FIG. 6: Perspective view of the manhole guard with a hoist device and a winch attached to the winch platform.

Referring now to FIGS. 5-6, some embodiments of the manhole guard 2 include mounting brackets 150, 250 designed to facilitate the use of a hoist device 40. For reference, these embodiments are referred to as hoist configurations of the manhole guard 2. The mounting brackets 150, 250 are typically hollow to reduce weight. This ensures the mounting brackets 150, 250 are easily portable, durable, and simple to assemble with tools commonly held on-site. However, non-hollow mounting brackets 150, 250 are encompassed within the present disclosure.

The hoist configuration generally includes a first mounting bracket 150 and a second mounting bracket 250. The first mounting bracket 150 is connected to the first wing 100, and the second mounting bracket 250 is connected to the second wing 200. The first mounting bracket 150 has a first top recess 152, a first middle recess 154, and a first lower recess 156. The first lower recess 156 is of a size, shape, and location so as to be capable of accepting one of the first wing rails 116, 118, 120 in an interference fit. In particular embodiments, the first lower recess 156 accepts the first middle wing rail 116 in an interference fit. The first middle recess 154 is of a size, shape, and location so as to be capable of accepting the first upper wing rail 118. The first middle recess 154 can be secured to the first upper wing rail 118 by at least one first mounting plate 158 which connects to the first mounting bracket 150 with one or more bolts 38. The first top recess 152 is of a size, shape, and location so as to be capable of accepting a crossbar 42 of any desired diameter.

As seen in FIGS. 5-6, the second mounting bracket 250 has a second top recess 252, a second middle recess 254, and a second lower recess 256. The second lower recess 256 is of a size, shape, and location so as to be capable of accepting one of the second wing rails 216, 218, 220 in an interference fit. In particular embodiments, the second lower recess 256 accepts the second middle wing rail 216 in an interference fit. The second middle recess 254 is of a shape, size, and location so as to be capable of accepting the second upper wing rail 218. The second middle recess 254 can be secured to the second upper wing rail 218 by at least one second mounting plate 258 which connects to the second mounting bracket 250 with one or more bolts 38. The second top recess 252 is of a size, shape, and location so as to be capable of accepting a horizontal crossbar 42 of any desired diameter.

In one particular embodiment, the first mounting bracket 150 and the second mounting bracket 250 each have an "L" shaped middle recess 154, 254. This "L" configuration allows the middle recess 154, 254 to horizontally accept an upper wing rail 118, 218 such that the mounting bracket 150, 250 can be lowered onto the upper wing rail 118, 218, causing the upper wing rail 118, 218 to be vertically displaced in the middle recess 154, 254 of the mounting bracket 150, 250. Once lowered, the mounting bracket 150, 250 sits directly on the upper wing rail 118, 218 in an interference fit, and the mounting bracket 150, 250 sits directly on the lower wing rail 116, 216 in an interference fit. This beneficial method of attaching the mounting brackets 150, 250 ensures that each mounting bracket 150, 250 can only be freed from the wing rails 116, 118, 216, 218 by applying upward force to the mounting bracket 150, 250. Any downward force applied to the mounting bracket 150, 250, such as during weighted operation of a hoist 40, solidifies the attachment of the mounting bracket 150, 250 to the wing rails 116, 118, 216, 218.

As seen in FIGS. 1, 5A, and 6, first slits 160 are present at the top of the middle recess 154 of the first mounting bracket 150, on opposing sides thereof. Similarly, second slits 260 are present at the top of the middle recess 254 of the second mounting bracket 250, on opposing sides thereof. The presence of the slits 160, 260 allows for the tightening of the middle recess 154, 254 around the circumference of the upper wing rail 118, 218 so as to create a secure interference fit. The slits 160, 260 are elongated and extend from the top of the middle recess 154, 254. When the bolts 38 securing the mounting plates 158, 258 to the mounting brackets 150, 250 are tightened, the slits 160, 260 permit the middle recesses 154, 254 to deform and pinch inward so as to form-fit the upper wing rails 118, 218.

The crossbar 42, when present, extends from the first top recess 152 of the first mounting bracket 150 to the second top recess 252 of the second mounting bracket 250. In some embodiments, as depicted in FIG. 5A, the top recesses 152, 252 are uncovered and designed to accept half of the circumference of the crossbar 42, with the other half of the circumference of the crossbar 42 protruding atop the top recesses 152, 252. This permits quick assembly and removal of the crossbar 42. In other embodiments, as depicted in FIG. 5B, at least one top recess 152, 252 is partly covered and designed to accept the entire circumference of the crossbar 42. In this configuration, the crossbar 42 extends through the recess 152, 252 which, as a whole, reduces wiggle and provides greater stability of the crossbar 42. In the embodiments depicted in FIG. 1 and FIG. 6, the first mounting bracket 150 has a partly covered top recess 152, and the second mounting bracket 250 has an uncovered top recess 252. In yet other configurations, both top recesses 152, 252 are partly or fully covered and designed to accept the full circumference of the crossbar 42. When in use with a manhole guard 2 arranged around a manhole, the crossbar 42 extends over the open manhole. The crossbar 42 can suspend a hoist device 40 over the manhole, the hoist device 40 being capable of transporting materials or people through the manhole between the surface and subsurface.

As depicted in FIG. 6, the crossbar 42 penetrates the first top recess 152 and the second top recess 252. This configuration helps keep the crossbar 42 in position in the top recesses 152, 252 of the mounting brackets 150, 250. In addition, the first top recess 152 and the second top recess 252 serve to distribute the force of the crossbar 42 throughout the manhole guard 2 during weighted operation of the hoist 40.

As seen in FIGS. 5A-5B, the first and second mounting plates 158, 258 ensure that the first mounting bracket 150 and the second mounting bracket 250 stay fastened to the first wing rails 116, 118 and the second wing rails 216, 218, respectively, with little wiggle or movement. Furthermore, attachment of the mounting brackets 150, 250 to multiple wing rails provides the benefit of evenly distributing force during weighted operation of the hoist 40.

As shown in FIG. 5A, certain embodiments of the manhole guard 2 further include a winch platform 46. The winch platform 46 can be connected to either or both mounting brackets 150, 250, on either the inner side of the mounting bracket (i.e., the side facing the manhole when the first arm 122 and second arm 222 are locking the first wing 100 and second wing 200 in a fixed position relative to the center section 10) or the outer side of the mounting bracket. A winch 44 can be attached to the winch platform 46 and can be used to operate the hoist device 40. Any suitable winch can be utilized with the manhole guard 2 of the present disclosure.

While the invention has been described with reference to multiple embodiments, it should be understood by those skilled in the art that various changes may be made and equivalents may be substituted without departing from the essential scope and spirit of the invention. In addition, many modifications may be made to adapt a particular situation or material to the teachings of the invention without departing from its essential scope. Therefore, it is intended that the invention not be limited to the particular embodiments disclosed in the present specification, but that the invention will include all embodiments falling within the scope of the claims.

What is claimed is:

1. A manhole guard comprising:

a plurality of sections connected for movement, the sections including a center section, a first wing, and a second wing, wherein the center section comprises a first post and a second post, the first wing comprises a first wing post connected to the first post by at least one first wing rail, and the second wing comprises a second wing post connected to the second post by at least one second wing rail;

a first arm connected to the center section and capable of locking the first wing into a fixed position relative to the center section; and a second arm connected to the center section and capable of locking the second wing into a fixed position relative to the center section;

wherein the first arm and the second arm operate independently of each other;

wherein at least one of the first arm or the second arm comprises a spring-loaded latch mechanism configured to accept either the first wing or the second wing;

wherein the first wing post is connected to the first post by at least an upper first wing rail and a lower first wing rail, and the second wing post is connected to the second post by at least an upper second wing rail and a lower second wing rail, and wherein the manhole guard further comprises:

a first mounting bracket connected to the first wing, and a second mounting bracket connected to the second wing;

the first mounting bracket having a first top recess, a first middle recess, and a first lower recess, wherein the first lower recess is configured to accept the first lower wing rail in an interference fit, and the first middle recess is configured to accept the first upper wing rail in an interference fit; and the second mounting bracket having a second top recess, a second middle recess, and a second lower recess, wherein the second lower recess is configured to accept the second lower wing rail in an interference fit, and the second middle recess is configured to accept the second upper wing rail in an interference fit.

2. The manhole guard of claim 1, wherein at least one of the first post, the second post, the first wing post, and the second wing post, comprises a telescopically-fitted adjustable foot.

3. The manhole guard of claim 1, wherein the first post is connected to the second post by a center section rail, the first arm is connected to the center section on the center section rail, and the second arm is connected to the center section on the center section rail.

4. The manhole guard of claim 1, wherein the spring-loaded latch mechanism is adapted to secure either the first wing into the fixed position of the first wing relative to the center section, or the second wing into the fixed position of the second wing relative to the center section.

5. The manhole guard of claim 4, wherein the spring-loaded latch mechanism is coupled with a curved capping portion designed to fit securely over the first wing rail or the second wing rail.

6. The manhole guard of claim 5, wherein the spring-loaded latch mechanism comprises a hood housing the curved capping portion, a spring, a bolt, a latch, and a trigger, wherein the spring spans the bolt and the trigger is configured to either increase or decrease tension on the spring.

7. The manhole guard of claim 1, further comprising:

a first slit extending from the first middle recess and configured to allow for tightening of the first middle recess around a circumference of the first upper wing rail; and a second slit extending from the second middle recess and configured to allow for tightening of the second middle recess to the second upper wing rail.

* * * * *